US007090017B2

(12) United States Patent
Justus et al.

(10) Patent No.: US 7,090,017 B2
(45) Date of Patent: Aug. 15, 2006

(54) LOW COST METHOD AND APPARATUS FOR FRACTURING A SUBTERRANEAN FORMATION WITH A SAND SUSPENSION

(75) Inventors: Donald M. Justus, Houston, TX (US); David Wesley Ritter, Katy, TX (US); Sanjay Vitthal, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 160 days.

(21) Appl. No.: 10/616,054

(22) Filed: Jul. 9, 2003

(65) Prior Publication Data

US 2005/0006089 A1 Jan. 13, 2005

(51) Int. Cl.
*E21B 43/26* (2006.01)

(52) U.S. Cl. ..... 166/308.1; 166/75.15; 137/3; 137/88

(58) Field of Classification Search ..... 166/308.3, 166/308.1, 308.2, 90.1, 271, 275, 263, 75.15, 166/250.01; 175/217, 218; 137/3, 88; 507/922
See application file for complete search history.

(56) References Cited

U.S. PATENT DOCUMENTS 3,326,536 A * 6/1967 Zingg et al. ..... 366/17
3,722,595 A * 3/1973 Kiel ..... 166/308.4
4,829,100 A * 5/1989 Murphey et al. ..... 523/131
5,325,921 A * 7/1994 Johnson et al. ..... 166/280.1
5,441,340 A * 8/1995 Cedillo et al. ..... 366/2
5,517,593 A * 5/1996 Nenniger et al. ..... 392/301
5,799,734 A * 9/1998 Norman et al. ..... 166/278
5,904,419 A * 5/1999 Arribau ..... 366/167.2
6,168,352 B1 * 1/2001 Chen et al. ..... 405/266
6,306,800 B1 * 10/2001 Samuel et al. ..... 507/129
6,659,175 B1 * 12/2003 Malone et al. ..... 166/250.1

* cited by examiner

*Primary Examiner*—David Bagnell
*Assistant Examiner*—Daniel P Stephenson
(74) *Attorney, Agent, or Firm*—Robert A. Kent; Baker Botts

(57) ABSTRACT

The present invention is directed to a low cost method and apparatus for fracturing a subterranean formation. The invention involves using a centrifugal pump to combine a fracture fluid, a sand suspension and liquid additive and discharge a mixture of these components into a high pressure pump that injects the mixture into the subterranean formation. The apparatus employs a control pinch valve to precisely control the amount of sand suspension being added to the mixture. The apparatus eliminates the need for expensive blenders, other equipment and associated personnel and provides a low cost means of fracturing the subterranean formation.

16 Claims, 2 Drawing Sheets

LOW COST METHOD AND APPARATUS FOR FRACTURING A SUBTERRANEAN FORMATION WITH A SAND SUSPENSION

BACKGROUND OF THE INVENTION

The present invention relates to a method and apparatus for fracturing a subterranean formation, and more particularly, to a low cost method and apparatus for fracturing a subterranean formation with a sand suspension.

The ordinary flow of hydrocarbons into a well may not be rapid enough to make a drilling operation commercially viable. Therefore, stimulating a subterranean formation can be helpful and necessary to facilitate the conductivity of hydrocarbons through a subterranean formation and into a drilled wellbore or hole. One means of stimulating hydrocarbon flow is through fracturing a subterranean formation.

A number of solutions have been proposed to fracture a subterranean formation. One solution proposes using dry sand that is either dumped from a truck or transferred from a storage device via a conveyor belt into a mixing device where it is mixed with a fracture fluid and liquid additives. The mixing device then discharges the mixture of sand and fracture fluid into one or more pumps that transfer the fluid downhole. This solution, however, can be very resource intensive as the sand, fracture fluid, and liquid additives require their own storage devices and pumps. In addition, a separate blending device is required to combine the sand and fluids. In some embodiments, this solution can require up to twenty-seven large pieces of equipment. This solution is also sometimes unable to maintain consistency in the composition of the fracture fluid. The composition can therefore be highly variable and can lead to unpredictable fracturing results.

Another solution for fracturing a subterranean formation uses a mixture of sand and fluid contained in a storage device that is constantly agitated to keep the sand suspended in the fluid. The storage device discharges the agitated mixture into a blending device where it can be blended with liquid additives and other fluids, which themselves require storage devices. The blending device outputs the sand fluid into one or more pumps that transfer the fluid downhole to accomplish fracturing the subterranean formation. This solution, however, is also resource intensive and requires an extremely expensive and complex piece of equipment in the agitating storage device. This solution may also not maintain consistency in the composition of the fracture fluid and can therefore lead to unpredictable fracturing results.

SUMMARY OF THE INVENTION

The present invention provides a method and apparatus for fracturing a subterranean formation, which meet the needs described above and overcome the deficiencies of the prior art.

In one embodiment, the present invention is directed to a low cost method of fracturing a subterranean formation. The method involves combining a fracture fluid and sand suspension into a centrifugal pump and pumping the mixture downhole into the subterranean formation. As used herein, a "sand suspension" is a mixture of any liquid and sand or any other oilfield hydraulic fracturing proppant, sufficient to suspend the proppant in the liquid for a period of at least one week. Preferably, the sand suspension is a mixture of xanthan in a concentration of about 60 lb./gal, sand in a concentration of about 20–24 lb./gal, and water, but could be any proppant and suspending agent.

The method is carried out first by injecting a fracture fluid into the centrifugal pump. The fracture fluid comprises a liquid, including, e.g., water, a gelling agent, a brine, an acid, oil (including oil from the formation being fractured), foam or any mixture of these liquids. Next, a controlled amount of the sand suspension is injected into the centrifugal pump. The method further includes the steps of discharging a mixture of the sand suspension and fracture fluid from the centrifugal pump having a certain concentration; monitoring the flow rate and concentration of the mixture; varying the amount of the sand suspension being injected into the centrifugal pump with a control pinch valve, such as a RED VALVE control pinch valve available from Red Valve Company, Inc. of Pittsburg Pa., or similar type valve, until a desired flow rate and concentration of the mixture is attained; and pumping the mixture downhole into the subterranean formation.

The method according to the present invention preferably also comprises the step of injecting a liquid additive into the centrifugal pump. The liquid may be any one of a number of fluids including, e.g., a breaker fluid, a clay control fluid, a cross-linking agent, a pH control agent or mixtures of any of these fluids.

In another embodiment, the present invention is directed to an apparatus for providing a low cost fracture of a subterranean formation. The apparatus includes the red valve that meters the flow of the sand suspension; the centrifugal pump, which is defined by an inlet into which the sand suspension is injected and an outlet out of which the mixture of the sand suspension and fracture fluid is discharged; and a downhole pump, which is a positive displacement that pumps the mixture discharged from the centrifugal pump downhole into the subterranean formation. Preferably, the downhole pump comprises two positive displacement pumps electrically coupled to one another by a LAN.

Preferably, the apparatus includes another positive displacement pump that injects liquid additive into the centrifugal pump. The apparatus also preferably includes an electronic control system comprising a flow meter and densometer and a microprocessor connected to the flow meter, densometer, control pinch valve and liquid additive pump. The microprocessor controls the control pinch valve and liquid additive pump thereby controlling the amount of sand suspension and liquid additive being added to the fracture fluid in the centrifugal pump in response to data feedback from the flow meter and densometer. The flow meter and densometer measure the flow rate and viscosity, respectively, of the mixture being discharged from the centrifugal pump.

Other and further objects, features and advantages of the present invention will be readily apparent to those skilled in the art upon a reading of the description of preferred embodiments which follows.

BRIEF DESCRIPTION OF THE DRAWINGS

The present invention is better understood by reading the following description of non-limitative embodiments with reference to the attached drawings, which are briefly described as follows.

It is to be noted, however, that the appended drawings illustrate only typical embodiments of this invention and are therefore not to be considered limiting of its scope, as the invention may admit to other equally effective embodiments.

DETAILED DESCRIPTION OF THE INVENTION

Figure 1:
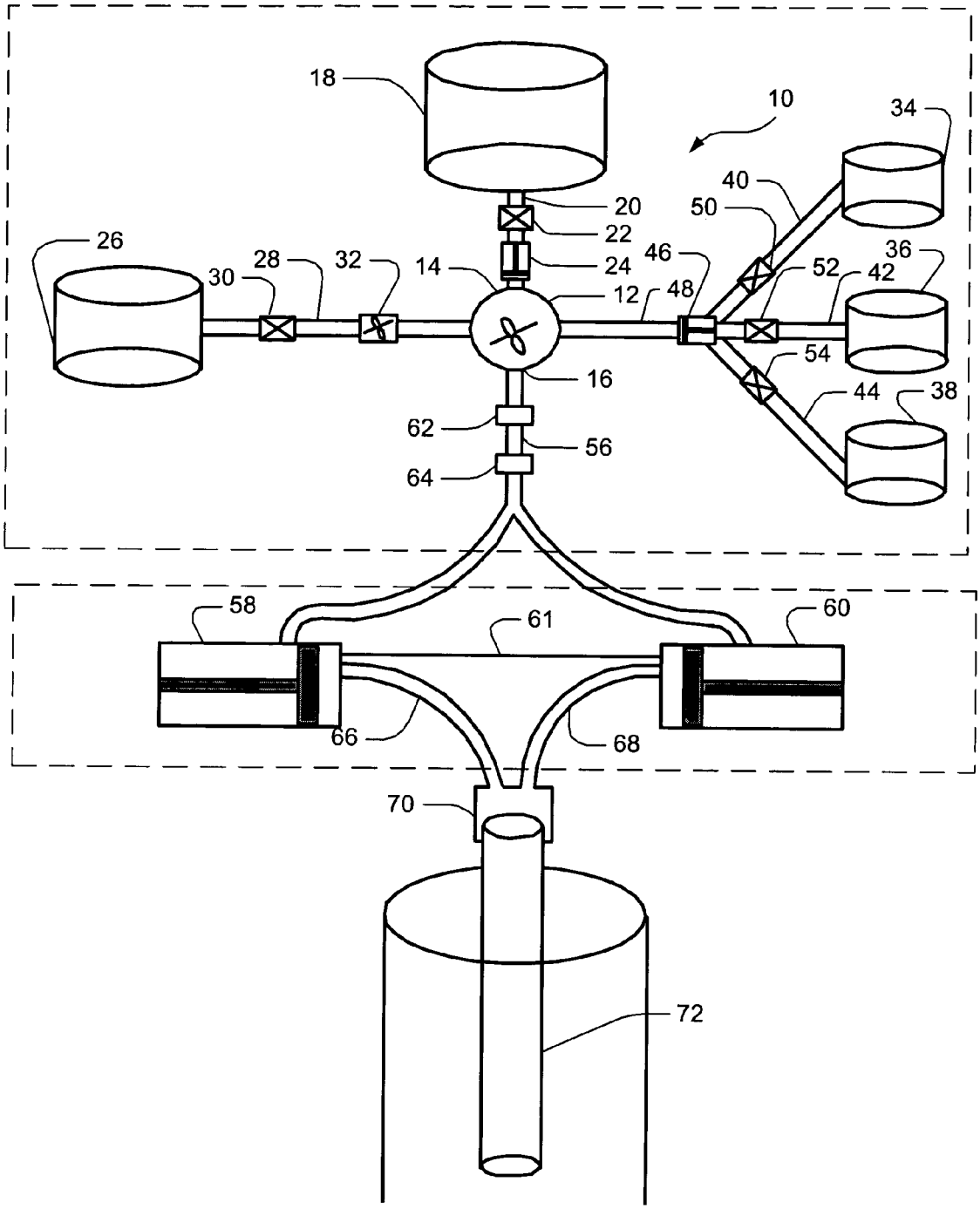
FIG. 1 is a schematic diagram of a low cost apparatus for fracturing a subterranean formation in accordance with the present invention.

The details of the present invention will now be discussed with reference to the figures. Turning to FIG. 1, a low cost apparatus for fracturing a subterranean formation in accordance with the present invention is shown generally by reference numeral 10. The apparatus 10 includes a centrifugal pump 12, which combines a fracture fluid, sand suspension and optionally one or more liquid additives. The centrifugal pump 12 has an inlet 14 into which the fracture fluid, sand suspension, and optionally liquid additive(s), are injected and an outlet 16 through which a mixture of the fracture fluid, sand suspension, and optionally liquid additive(s), is discharged. The centrifugal pump 12 preferably pumps 100 barrels/min, but may have a larger or smaller output depending upon the size of the subterranean formation sought to be fractured and downhole conditions.

The fracture fluid is stored in a storage tank 18, which is typically brought to the site by a tractor trailer. In offshore applications, the tank 18 would be brought to the site inside of a frac boat. A conduit 20, preferably a heavy gauge hose, delivers the fracture fluid from the storage tank 18 to the centrifugal pump 12. The flow of the fracture fluid is metered by a valve 22, which is preferably a butterfly or ball valve, but may be another type of similar device. In applications where the storage tank 18 is located below the centrifugal pump 12, e.g., in offshore applications where the storage tank 18 is in a frac boat, a positive displacement pump 24 coupled to the conduit 20 may be provided to meter the flow of the fracture fluid into the centrifugal pump 12. As noted above, the fracture fluid comprises a liquid such as water, a gelling agent, a brine, an acid, oil (including oil from the formation being fractured), foam, or other similar fluid or mixtures of one or more of these liquids. The fracture fluid will usually be prepared offsite. However, when the fracture fluid is simply water or any fluid easily prepared on-site, the fluid may be obtained or prepared on-site.

The sand suspension is stored in a vat or tank 26. The tank 26 is also usually taken to the site on a tractor trailer or tanker ship. The tank 26 will typically be smaller than the fracture fluid storage tank 18, since the mixture contains less sand suspension than fracture fluid. In fact, the tank 26 can be transported on the same trailer or ship that transports the centrifugal pump. As noted above, the sand suspension may be any number of mixtures of fluid and proppants, but is preferably a mixture of xanthan in a concentration of about 60 lb./gal, sand in a concentration of about 20–24 lb./gal, and water. The sand suspension can be prepared either on site or off site. If prepared off site, the ingredients making up the suspension will be transported on site in separate containers or in tank 26. If the sand suspension is prepared on site, it is made in tank 26 or another tank like it.

A conduit 28, preferably a heavy gauge hose, delivers the sand suspension from the tank 26 to the centrifugal pump 12. A control pinch valve 30 coupled to the conduit 28 meters the flow of the sand suspension into the centrifugal pump 12. The advantage of using a control pinch valve 30, such as a RED VALVE, to meter the flow of sand suspension is that the flow rate of the sand suspension can be precisely regulated. This is critical for obtaining a mixture that avoids slugging, yet achieves an effective fracture. An optional centrifugal pump 32 also coupled to the conduit injects the sand suspension into the centrifugal pump 12.

Liquid additives are stored in tanks or vats 34, 36 and 38. While three liquid additive storage tanks are illustrated, as those or ordinary skill in the art will appreciate any number of liquid additives may be employed, including none at all. As pointed out above, the liquid additives may include, but are not limited to, a breaker fluid, a clay control fluid, a cross-linking agent, a pH control agent or mixtures thereof. Typically, the liquid additives will be prepared off site. Since such a small amount of liquid additives are typically injected into the mixture, the tanks 34, 36, and 38 can also be sized so as to fit on the same tractor trailer or tanker ship that transports the sand suspension and centrifugal pump 12.

Conduits 40, 42 and 44 couple the tanks 34, 36 and 38, respectively, to a positive displacement pump 46, which injects the liquid additive(s) into the centrifugal pump 12 via conduit 48. The conduits 40, 42 and 44 are preferably formed of a heavy gauge hose, but as those of ordinary skill in the art will recognize other similar devices may be used for all of the conduits used in the apparatus 10. Valves 50, 52 and 54 are coupled to the conduits 40, 42 and 44 and meter/regulate the flow of the liquid additives. Valves 50, 52 and 54 are preferably a butterfly valve or a ball valve or equivalent thereto.

A conduit 56, which is preferably a heavy gauge hose, connects the centrifugal pump 12 to a pair of positive displacement pumps 58 and 60. A flow meter 62 is coupled to the conduit 56. The flow meter 62 measures the flow rate of the mixture being discharged from the centrifugal pump 12. The flow meter 62 may be any conventional device for measuring flow rate. A densometer 64 is also coupled to the conduit 56. It measures the density of the mixture being discharged from the centrifugal pump 12. The densometer 64 may be any conventional device for measuring the density of a dynamic fluid.

The positive displacement pumps 58 and 60 are high pressure pumps, which pump the mixture downhole in the subterranean formation at pressures as high as 10,000–15,000 psi (lbs./in$^2$). The positive displacement pumps 58 and 60 are preferably 6 inch HT-2000s. As those of ordinary skill in the art will appreciate, any number of positive displacement pumps can be used to pump the mixture downhole depending upon the size of the subterranean formation sought to be fractured and downhole conditions. The positive displacement pumps 58 and 60 are preferably electronically coupled by a LAN (Local Area Network) cable 61, e.g., a JLAN. The LAN cable 61 enables the positive displacement pumps 58 and 60 to be operated by one well operator. Conduits 66 and 68 deliver the high pressure mixture to a wellhead 70, which is then delivered downhole through conventional drill pipe 72.

Figure 2:
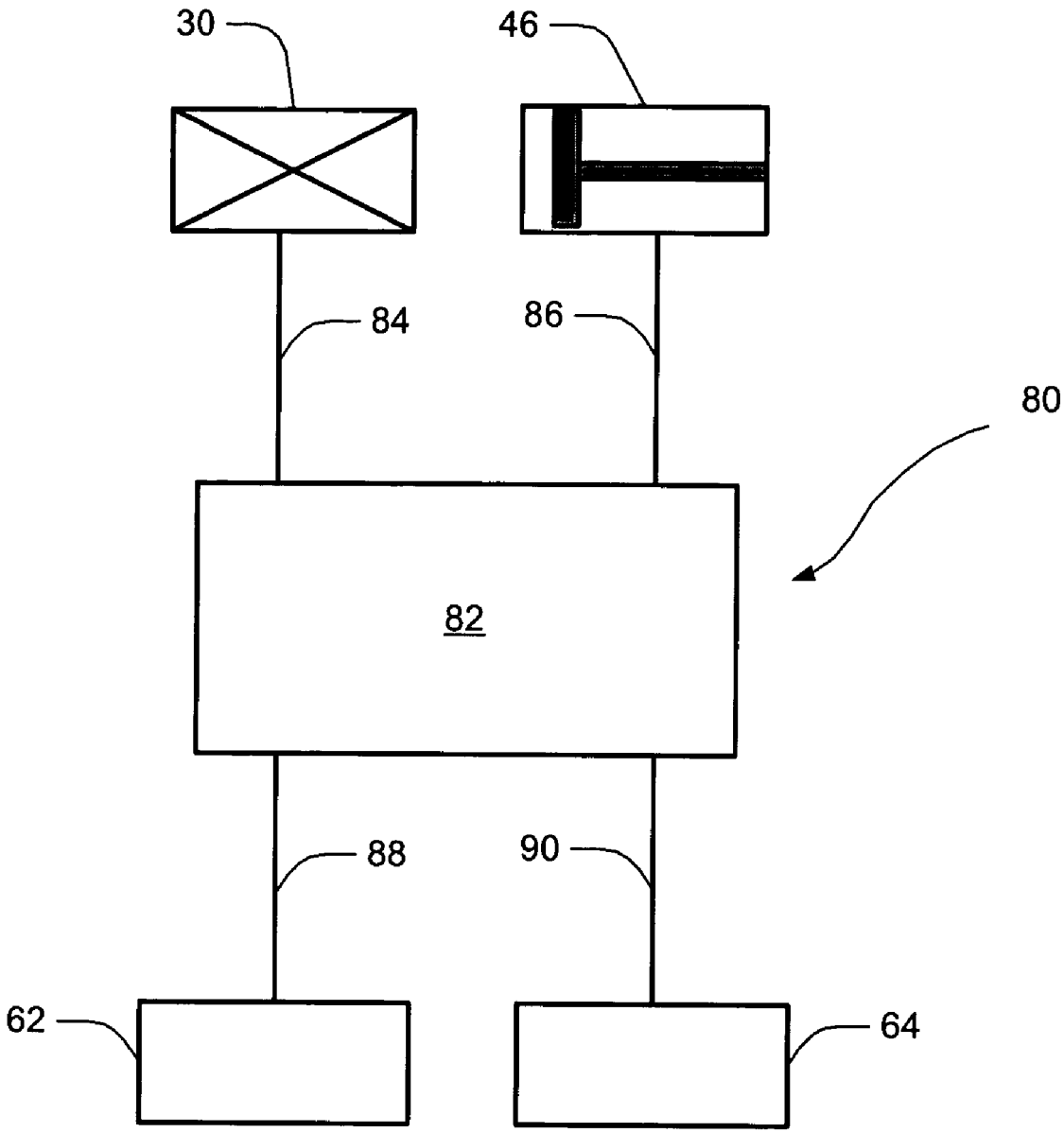
FIG. 2 is a schematic diagram of an electronic control system for the apparatus shown in FIG. 1.

The apparatus 10 is preferably controlled by an electronic control system 80, as shown in FIG. 2. The electronic control system comprises a microprocessor 82, which is connected to the control pinch valve 30 via an electrical wire 84, and the liquid additive pump 46 via electrical wire 86. The microprocessor 82 is also connected to the flow meter 62 via electrical wire 88 and densometer 64 via electrical wire 90. The microprocessor 82 receives signals from the flow meter 62 and densometer indicative of the flow rate and density, respectively, of the mixture being discharged from the centrifugal pump 12.

The microprocessor 82 analyses the flow rate of the mixture to ascertain whether the respective components of the mixture are being supplied to the centrifugal pump 12 at optimum flow rates. If the rates at which the sand suspension and liquid additive(s) being added to the centrifugal pump 12 are too high or too low, the microprocessor 82 can send a control signal to the control pinch valve 30 and/or liquid additive pump 46 to adjust the rates at which these components are being metered into the centrifugal pump 12.

The microprocessor 82 also analyses the density of the mixture to ascertain whether the mixture has the appropriate viscosity to be effectively pumped downhole and to effectively fracture the formation. If the mixture is either too dense or not sufficiently dense, the microprocessor 82 can send a control signal to the control pinch valve 30 and/or liquid additive pump 46 to adjust the composition of the mixture.

As those of ordinary skill in the art will appreciate, the electronic control system 80 can also be electronically connected to the other valves and pumps in the apparatus 10 so as to control these other nodes. It can also be connected to the positive displacement pumps 58 and 60 and thereby electronically control virtually the entire operation.

An advantage of the present invention is that the centrifugal pump 12, sand suspension tank 26, liquid additive tanks 34, 36 and 38, and associated valves and pumps and the electronic control system 80 are all sized such that they can all be brought to a well site on a single tractor trailer or tanker ship. Additionally, because the apparatus employs an electronic control system 80 that can link all of these pieces of equipment, all of this equipment can be operated by a single well operator. This is indicated in FIG. 1 by the dashed box, which is drawn around all of these pieces of equipment.

The positive displacement pumps 58 and 60 are typically brought to a job site on two tractor trailers. With both pumps 58 and 60 being linked by a LAN cable, however, a single operator can operate both pumps, as indicated in FIG. 1 by the dashed box drawn around both pumps.

Thus, in the event that the fracture fluid is supplied at the site, e.g., from ocean water or a nearby lake or pond, the present invention may be carried out with as few as 3 pieces of equipment. In the event that the fracture fluid needs to be brought to the job site, then the present invention may be carried out with as few as 4 pieces of equipment.

Thus, the present invention can by carried out using 3–4 pieces of equipment being operated by 3–4 operators. This represents a significant reduction in the number of pieces of equipment and well operators that have been needed to carry out conventional fracture jobs. Indeed, conventional fracture jobs typically utilize between 10 and upwards of 30 pieces of equipment and approximately 10–12 operators. Accordingly, the present invention provides a low cost alternative to conventional fracture methods and apparatuses.

Therefore, the present invention is well adapted to carry out the objects and attain the ends and advantages mentioned as well as those that are inherent therein. While numerous changes may be made by those skilled in the art, such changes are encompassed within the spirit of this invention as defined by the appended claims.

What is claimed is:

1. A method of fracturing a subterranean formation comprising the steps of:

injecting a fracture fluid into a centrifugal pump;

injecting a controlled amount of a sand suspension into the centrifugal pump;

mixing the fracture fluid and sand suspension in the centrifugal pump;

discharging the mixture of the sand suspension and fracture fluid from the centrifugal pump;

measuring the concentration of the mixture being discharged from the centrifugal pump and comparing the measured concentration of the mixture to a desired concentration of the mixture;

varying the amount of the sand suspension being injected into the centrifugal pump with a control pinch valve until a the desired concentration of the mixture is attained; and pumping the mixture downhole into the subterranean formation using a separate pump.

2. A method of fracturing a subterranean formation according to claim 1 further comprising the step of injecting a liquid additive into the centrifugal pump.

3. A method of fracturing a subterranean formation according to claim 2 wherein the liquid additive comprises a liquid selected from the group consisting of a breaker fluid, a clay control fluid, a cross-linking agent, a pH control agent and mixtures thereof.

4. A method of fracturing a subterranean formation according to claim 1 wherein the fracture fluid comprises a liquid selected from the group consisting of water, gelling agent, brine, acid, oil, foam and mixtures thereof.

5. A method of fracturing a subterranean formation according to claim 4 wherein the oil has been recovered from the subterranean formation being fractured.

6. A method of fracturing a subterranean formation according to claim 1 wherein the sand suspension comprises a mixture of xanthan in a concentration of about 60 lb./gal and sand in a concentration of about 20–24 lb./gal.

7. A method of fracturing a subterranean formation according to claim 6 wherein the sand suspension further comprises water.

8. An apparatus for fracturing a subterranean formation comprising:

a control valve that meters flow of a sand suspension;

a centrifugal pump having an inlet into which the sand suspension is injected and an outlet out of which a mixture of the sand suspension and a fracture fluid is discharged;

means for measuring the concentration of the mixture being discharged from the centrifugal pump, comparing the measured concentration of the mixture to a desired concentration of the mixture and sending control signals to the control valve to vary the amount of the sand suspension being injected into the centrifugal pump until the desired concentration of the mixture is attained; and a separate pump that pumps the mixture discharged from the centrifugal pump downhole into the subterranean formation.

9. An apparatus for fracturing a subterranean formation according to claim 8 wherein the means comprises an electronic control system that comprises a flow meter and densometer that measure the flow rate and viscosity, respectively, of the mixture being discharged from the centrifugal pump and a microprocessor connected to the flow meter, densometer, and control valve.

10. An apparatus for fracturing a subterranean formation according to claim 9 further comprising a positive displacement pump that injects a liquid additive into the centrifugal pump.

11. An apparatus for fracturing a subterranean formation according to claim 10 wherein the positive displacement pump is electronically connected to the electronic control system.

12. An apparatus for fracturing a subterranean formation according to claim 10 wherein the liquid additive comprises a liquid selected from the group consisting of a breaker fluid, a clay control fluid, a cross-linking agent, a pH control agent and mixtures thereof.

13. An apparatus for fracturing a subterranean formation according to claim 8 further comprising another centrifugal pump disposed between the control valve and the centrifugal pump that injects the sand suspension into the centrifugal pump.

14. An apparatus for fracturing a subterranean formation according to claim 8 wherein the downhole pump comprises two positive displacement pumps electrically coupled to one another by a Local Area Network cable.

15. An apparatus for fracturing a subterranean formation according to claim 8 wherein the sand suspension comprises a mixture of xanthan in a concentration of about 60 lb./gal, sand in a concentration of about 20–24 lb./gal, and water.

16. An apparatus for fracturing a subterranean formation according to claim 8, wherein the fracture fluid comprises a liquid selected from the group consisting of water, gelling agent, brine, acid, oil, foam and mixtures thereof.

* * * * *